United States Patent [19]

Oishi et al.

[11] Patent Number: 4,982,751

[45] Date of Patent: Jan. 8, 1991

[54] COMPACT CASE

[75] Inventors: Yoshihiro Oishi; Nobue Tanaka, both of Shizuoka, Japan

[73] Assignee: Pola Chemical Industries, Inc., Japan

[21] Appl. No.: 412,430

[22] Filed: Sep. 26, 1989

[51] Int. Cl.[5] ..... A45D 33/02

[52] U.S. Cl. ..... 132/299; 206/823

[58] Field of Search ..... 132/295, 298, 299, 301, 132/303; 206/581, 823

[56] References Cited

U.S. PATENT DOCUMENTS

| | | | |
|---|---|---|---|
| 1,459,450 | 6/1923 | Schmidt | 132/298 |
| 1,608,449 | 11/1926 | Wendel | 132/298 |
| 1,666,901 | 4/1928 | Hough | 132/298 |
| 1,694,727 | 12/1928 | Allen | 132/299 |
| 1,814,747 | 7/1931 | Friedman | 132/298 |
| 2,468,153 | 4/1949 | Wolfers | 132/299 |
| 2,554,489 | 5/1951 | Crane | 132/298 |

FOREIGN PATENT DOCUMENTS

| | | |
|---|---|---|
| 60-57318 | 4/1985 | Japan . |
| 62-152970 | 9/1987 | Japan . |
| 1-115418 | 8/1989 | Japan . |

*Primary Examiner*—John J. Wilson
*Assistant Examiner*—F. LaViola, Jr.
*Attorney, Agent, or Firm*—Oliff & Berridge

[57] ABSTRACT

A compact case designed with a technique of enabling a cosmetic material to be discharged always smoothly while maintaining the desired performance of sealing the cosmetic material to prevent the same from hardening. A flat plate is disposed movably in a case body, and a sealed sack to be filled with the cosmetic material is disposed under this flat plate. A pump capable of being driven by the flat plate to discharge the cosmetic material is provided in the sealed sack. The pump has a discharge hole formed in the flat plate. A cover is stretched over the upper surface of the flat plate to cover the discharge hole. A slit is formed in the cover so as to communicate with the discharge hole.

6 Claims, 7 Drawing Sheets

COMPACT CASE

BACKGROUND OF THE INVENTION

This invention relates generally to compact cases and, more particularly, to a compact case for containing a cosmetic material.

In general, it is necessary to prevent cosmetic materials such as foundations having volatile oil components from contacting the air when the cosmetic materials are not used.

Compact cases for containing this kind of cosmetic material are therefore designed carefully to shut off the cosmetic material from the outside air. For example, various types of compact cases have been proposed to satisfy this condition, as described below.

The one disclosed in Japanese Utility Model Laid-Open No. 60-57318 has a structure, such as that shown in FIG. 11, in which a retaining plate 30 having a multiplicity of holes 31 formed in its surface is disposed on the surface of a cosmetic material so that the cosmetic material can be gradually discharged through the multiplicity of holes 31 to attach to a puff or the like.

The one disclosed in Japanese Utility Model Laid-Open No. 62-152970 has a structure, such as that shown in FIG. 12, in which a cosmetic material 20 is packed in a sealed sack 21 in which a pump 22 for discharging the cosmetic material 20 is disposed. The pump 22 is constructed so as to connect a pair of flat side portions of the sealed sack 21 facing each other and has a cylinder 23 disposed on the side of one of these side portions and a piston 24 disposed on the side of the other.

A coil spring 25 is disposed between the cylinder 23 and the piston 24 to urge these members away from each other.

This compact case is used in such a manner that the opposite side portions of the sealed sack 21 are pressed toward each other to evacuate the cylinder cavity, the cylinder is then charged with the cosmetic material 20 by removing the pressure upon the side portions, and the cosmetic material 20 changed inside the cylinder is discharged through a valve 26 by pressing the side portions again.

However, these conventional compact cases entail specific problems, as described below.

The type of compact case shown in FIG. 11 is advantageous because its structure is simple, but entails a risk of hardening of the cosmetic material since the cosmetic material is always in contact with the air through the holes 31.

In the arrangement shown in FIG. 12, the whole of the cosmetic material 20 is confined substantially in a sealing manner, but part of the cosmetic material located in the vicinity of the valve may harden since the valve 26 is exposed. There is therefore a risk of the movement of the valve 26 being obstructed and, hence, a risk of failure to smoothly discharge the cosmetic material 20.

Another type of conventional compact case is disclosed in Japanese Utility Model Laid-Open No. 1-115418.

SUMMARY OF THE INVENTION

It is an object of the present invention to provide a technique of enabling the cosmetic material to be smoothly discharged while preventing the performance of sealing the cosmetic material and, hence, hardening of the same.

To achieve this object, according to the present invention, there is provided a compact case constructed as described below. A flat plate is disposed movably in a case body, and a sealed sack to be filled with a cosmetic material is disposed under the flat plate. A pump capable of being driven by the flat plate to discharge the cosmetic material is disposed in the sealed sack. The pump has a discharge hole formed in the flat plate. A cover is stretched over the upper surface of the flat plate so as to cover the discharge hole. A slit is formed in the cover so as to communicate with the discharge hole.

The slit can be formed so as to be slanted as viewed in a cross section of the cover. The compact case in accordance with the present invention may be constructed as described below.

The flat plate is disposed in the case body so as to be moved by being pressed, and the sealed sack to be charged with a cosmetic material is disposed under the flat plate.

Preferably, the arrangement may be such that the flat plate is designed to be swingable by being pivotally supported on the case body; the pump is disposed in a position shifted from the axial support point of the flat plate; and a portion of the pump, e.g., a piston is fixed to the bottom of the case body; and that the flat plate is swung to effect expansion and contraction movements of the pump for resetting of the pump and for discharging operation of the same.

In this arrangement, the pump is operated to temporarily create a negative pressure in the sealed sack to introduced the cosmetic material into the pump and to thereafter make the introduced cosmetic material to flow out through the discharge hole. Since the cover is stretched over the upper surface of the flat plate in which the discharge hole is formed, the cosmetic material made to flow out is discharged through the slit after passing through the gap between the flat plate and the cover.

The sealing performance of the slit in the closed state is further improved by forming if the slit is slanted as viewed in a cross section of the cover.

The arrangement may also be such that the flat plate is axially supported swingably; the pump is disposed in a position shifted from the axis about which the flat plate is supported; and the piston of the pump is fixed to a tray fitted in the case body, thereby enabling the pump to be operated by the swinging motion of the flat plate. It is thereby possible to easily reset the pump by linking the opening/closing operation of a lid and the seesaw motion of the flat plate with each other.

The compact case of the present invention has a construction in which a flat plate is disposed movably in a case body; a sealed sack to be filled with a cosmetic material is disposed under the flat plate; a pump capable of being driven by the flat plate to discharge the cosmetic material is disposed in the sealed sack, the pump having a discharge hole formed in the flat plate; a cover is stretched over the upper surface of the flat plate so as to cover the discharge hole; and a slit is formed in the cover so as to communicate with the discharge hole.

The pump is operated by moving the flat plate to discharge the cosmetic material contained in the sealed sack through the discharge hole by the pumping effect. The discharged cosmetic material is extruded onto the cover through the slit of the cover. Since the discharge hole is closed by the cover, there is no possibility of hardening of the cosmetic material in the vicinity of the discharge hole.

Preferably, the slit is slanted as viewed in a cross section of the cover.

The arrangement may be such that the flat plate is axially supported swingably; the pump is disposed in a position shifted from the axial support point the flat plate; and a portion of the pump is fixed to the case body, thereby enabling the pump to effect expansion/-contraction moments for resetting and discharging.

In this case, the flat plate may be supported on a swingable frame which has a pair of axial projections formed on its side wall portions offset from its center toward its front end, thereby supporting the flat plate at a position closer between the center and the front end of the case body.

For practical use, the compact case is constructed in such a manner that the lid of the case drives the flat plate to reset the pump when closed.

The pump may be of any type including one consisting of a cylinder fixed to the lower portion of the flat plate, a piston fixed to the case body, a cylinder valve disposed at an outlet hole of the cylinder and serving as a check valve through which the cosmetic material can flow from the interior of the cylinder to the discharge hole, and a piston valve disposed at a suction hole of the piston and serving a check valve through which the cosmetic material can flow from the interior of the sealed sack to the interior of the cylinder, or one using a diaphragm. Any type of pump capable of operating by being driven with the flat plate will suffice.

BRIEF DESCRIPTION OF THE DRAWINGS

FIG. 1 is an exploded perspective view of a first embodiment;

FIGS. 2 and 3 are cross-sectional views of the first embodiment;

FIG. 4 is an enlarged cross-sectional view of a portion shown in FIG. 3;

FIGS. 5 and 6 are enlarged cross-sectional views of a portion shown in FIG. 2;

FIG. 7 is a bottom view of a piston;

FIG. 8 is a cross-sectional view illustrating a used state;

FIG. 9 is an enlarged cross-sectional view of a slit;

FIG. 10 is an exploded perspective view of a second embodiment;

FIG. 11 is a perspective view; and

FIG. 12 is a cross-sectional view.

DESCRIPTION OF THE PREFERRED EMBODIMENTS

Referred embodiments of the present invention will be described below with reference to FIGS. 1 to 10.

Embodiment 1

Figure 1:
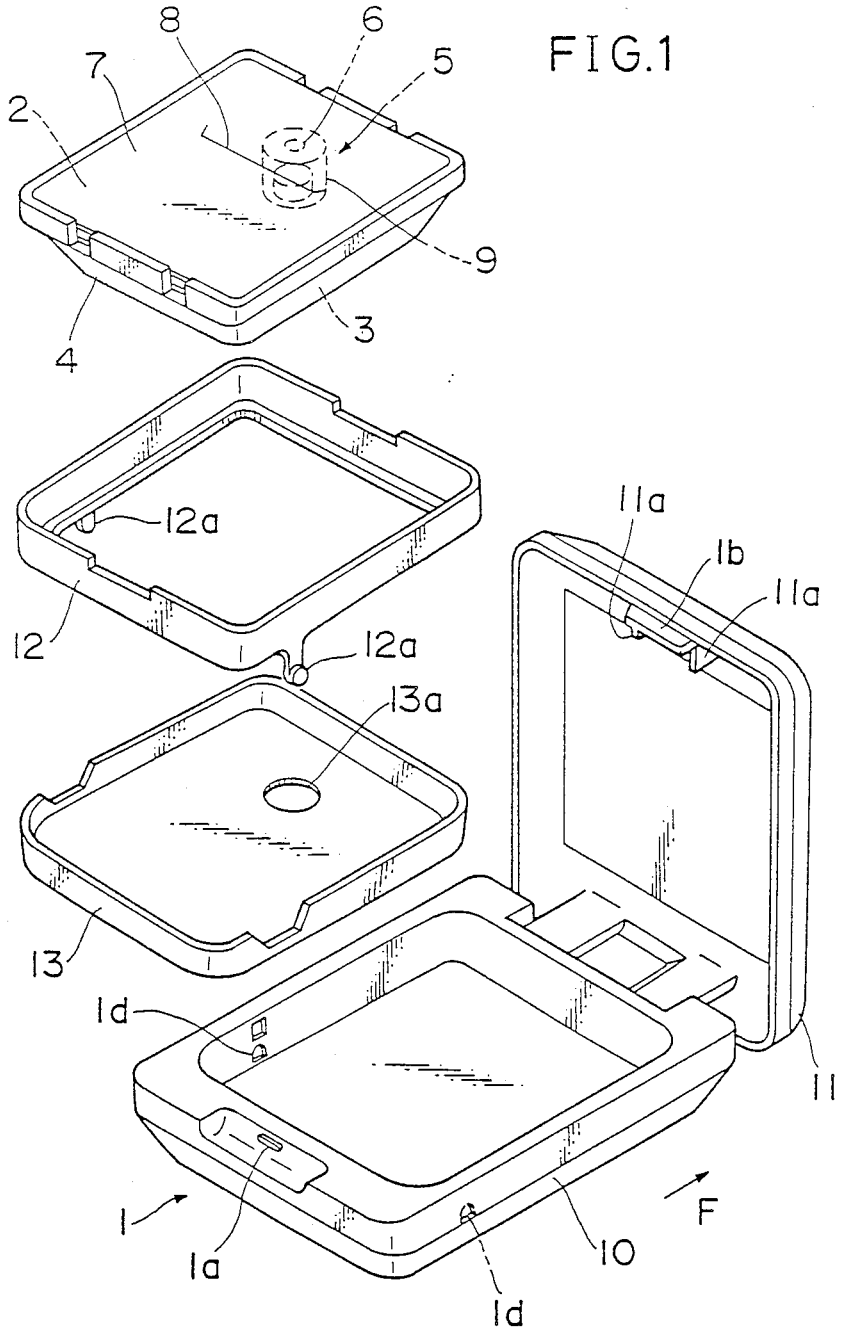
FIGS. 1 to 10 show embodiments of the present invention.
Figure 2:
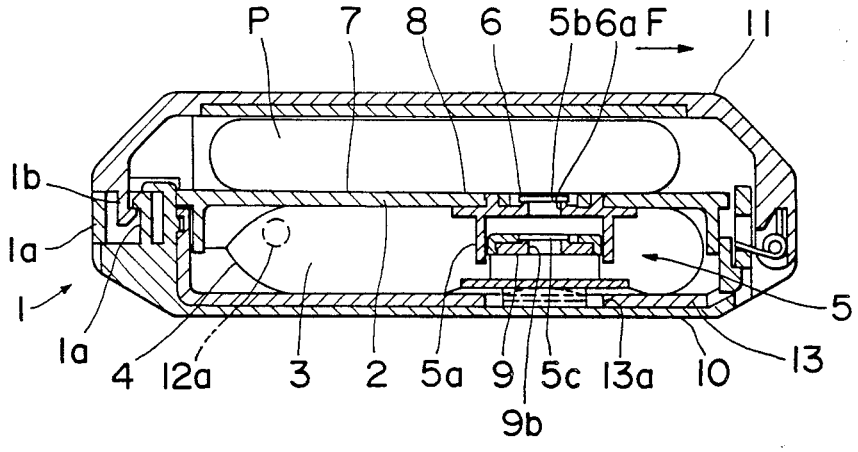
Figure 3:
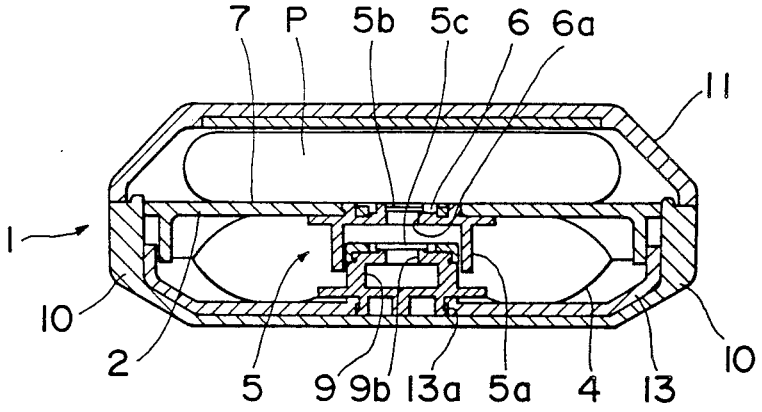

Referring to FIGS. 1 to 3, a compact case 1 has a case body 10 having an accommodation space, and a lid 11. A projection 1*a* formed on a front end portion of the case body 10 is detachably engaged with a projection 1*b* formed on a front end portion of the lid 11 so as to be perpendicular to the lid 11. Pressing portions 11*a* are formed on an internal surface of the front end portion of the lid 11.

An inner tray 13 is fixedly fitted in the accommodation space of the case body 10. A pair of engagement recesses 1*d* are formed in the inner surfaces of side wall portions of the case body 10 in positions offset from the center toward the front end. An engagement hole 13*a* is formed in a bottom portion of the inner tray 13.

A swingable frame 12 is fitted in the case body 10. The swingable frame 12 has a pair of axial projections 12*a* which extend from its side wall portions closer to its front end and which rotatably engage with the engagement recesses 1*d*. A flat plate 2 retained by the swingable frame 12 can be swung about the axial projections 12*a*. A front end portion of the swingable frame 12 is pressed by the pressing portion 1*a* when the lid 11 is closed.

The flat plate 2 is placed on the swingable frame 12. A sealed sack 4 to be filled with a cosmetic material 3 such as a foundation is disposed under the flat plate 2. The sealed sack 4 is formed of a thin laminate sheet in order to prevent evaporation of volatile oil components of the cosmetic material 3 and, hence, to prevent any denaturation of the cosmetic material 3.

A pump 5 for discharging the cosmetic material 3 is provided inside the sealed sack 4. As shown in FIGS. 2 and 3, the pump 5 has a cylinder 5*a* fixed to a lower surface of the flat plate 2, a piston 9 fixed to an engagement hole 13*a* the inner tray 13, a cylinder valve 5*b* provided at an outlet hole 6*a* to serve as a check valve which allows the cosmetic material 3 to flow out of the cylinder 5*a* through the outlet hole 6*a*, and a piston valve 5*c* provided at a suction hole 9*b* of the piston 9 to serve as a check valve which allows the cosmetic material 3 to flow out of the sealed sack 4 to the interior of the cylinder 5*a*. In this structure of the pump 5, the piston valve 5*c* fitted in the cylinder 5*a* operates to extrude the cosmetic material 3 to the outside through the outlet hole 6*a* as the distance between the flat plate 2 and the inner tray 13 is changed. The pump 5 is disposed in a position sightly shifted rearward from the axial support points of the axial projections 12*a* (in the direction of the arrow F of FIG. 2), and is fitted at the bottom of the piston 9 in the engagement hole 13*a* of the inner tray 13, thereby being fixed to the case body 10.

A discharge hole 6 is formed in the flat plate 2 to enable the cosmetic material 3 to be discharged. The discharge hole 6 communicates with the cylinder valve 5*b*. A cover 7 is stretched over the upper surface of the flat plate 2 to cover the discharge hole 6.

A slit 8 is formed in the cover 7 so as to communicate with the discharge hole 6. The slit 8 is slanted as viewed in a cross section of the cover shown in FIG. 9. The sealing performance can be further improved by slanting the slit 8 in this manner.

As shown in FIGS. 1 and 2, the slit 8 is made as a line placed in a position shifted from said discharge hole 6.

Figure 4:
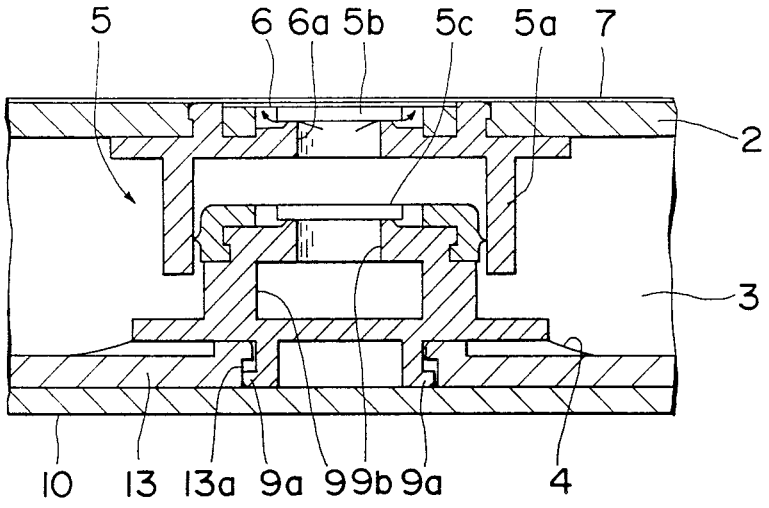
Figure 5:
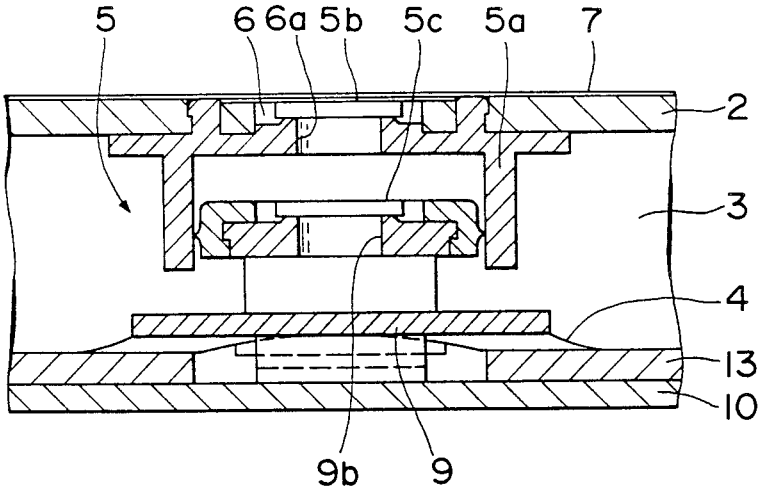
Figure 6:
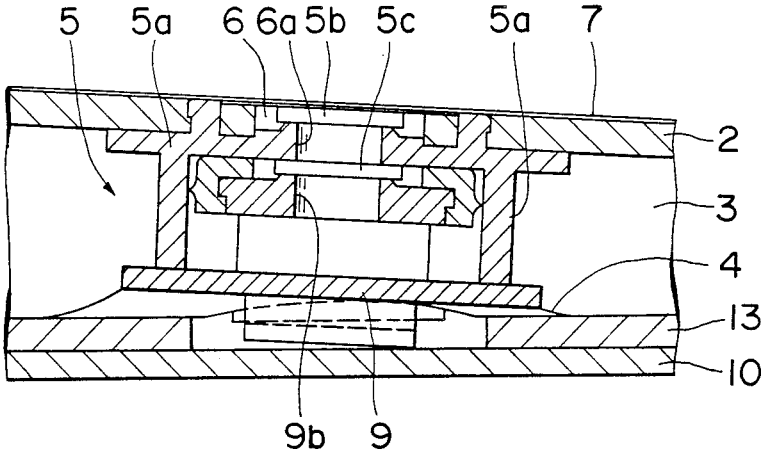
Figure 7:
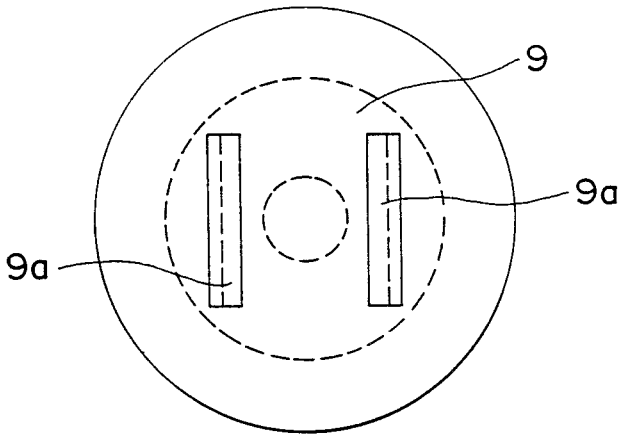

The structure of the pump 5 will be described below in more detail with reference to FIGS. 4 to 7. FIG. 4 is an enlarged cross-sectional view of the pump corresponding to FIG. 3, FIGS. 5 and 6 are enlarged cross-sectional views of the pump corresponding to FIG. 2, and FIG. 7 is a bottom view of the piston 9.

A pair of engagement projections 9*a* are formed on the bottom surface of the piston 9 which are fitted in the engagement hole 13*a* comparatively loosely. The piston 9 therefore have a certain degree of freedom of moving therein, as shown in FIGS. 5 and 6.

When the lid 11 is closed, the front end portion of the swingable frame 12 is pressed by the pressing portions 11*a* so that the flat plate 2 is maintained parallel to the case body 10. At this time, in the pump 5, the cylinder 5*a* is located at the top dead center, and the cosmetic material 3 has been introduced into the pump 5.

The operation of the compact case in accordance with this embodiment will be described below.

Figure 8:
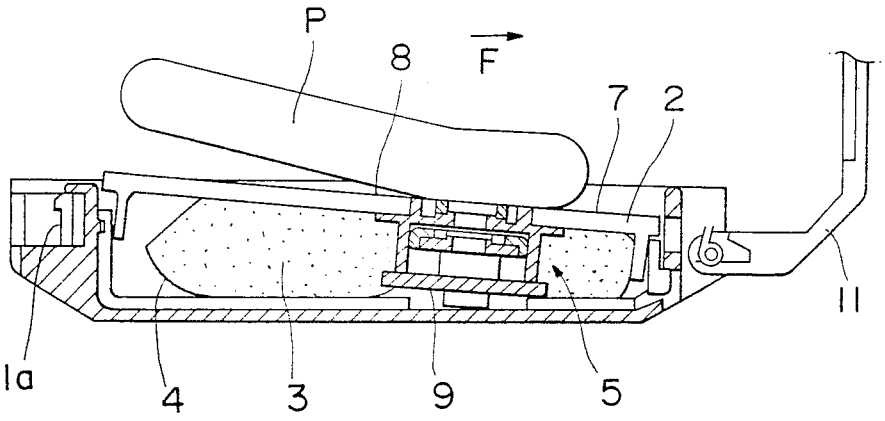
Figure 9:
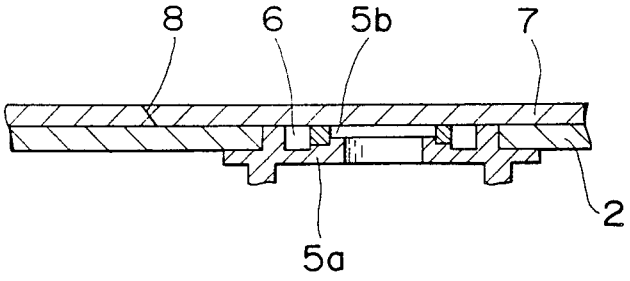

As the flat plate 2 is pressed with a puff P after the lid 11 has been opened, the rear end of the flat plate is depressed by a seesawing motion, and the cylinder 5*a* is thereby moved downward, as shown in FIG. 8. The part of the cosmetic material 3 thereby compressed in the pump 5 passes through the cylinder valve 5*b* and flows out through the discharge hole 6.

The piston 5*c* has a function of preventing the cosmetic material 3 from flowing in the reverse direction during this operation. The cosmetic material 3 made to flow out through the discharge hole 6 in this manner is extruded to the outside while opening the slit 8.

The lid 11 is thereafter closed, and the cylinder 5*a* is moved to the top dead center again, thereby introducing the cosmetic material 3 into the pump 5. As described above, the swinging motion of the flat plate 2 can be effected only by closing the lid 11 and there is no need for any specific means such as a return spring provided in the pump 5 to enable the same to effect expansion/contraction movement for resetting and discharging.

Embodiment 2

Figure 10:
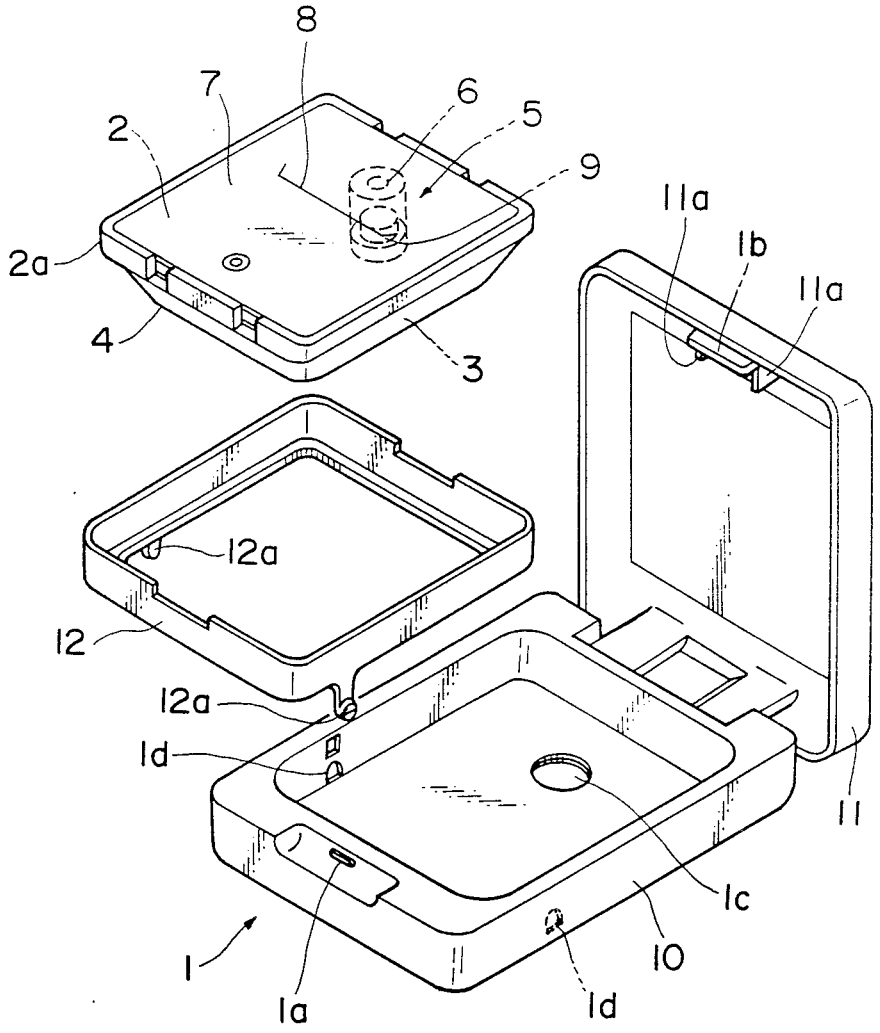
Figure 11:
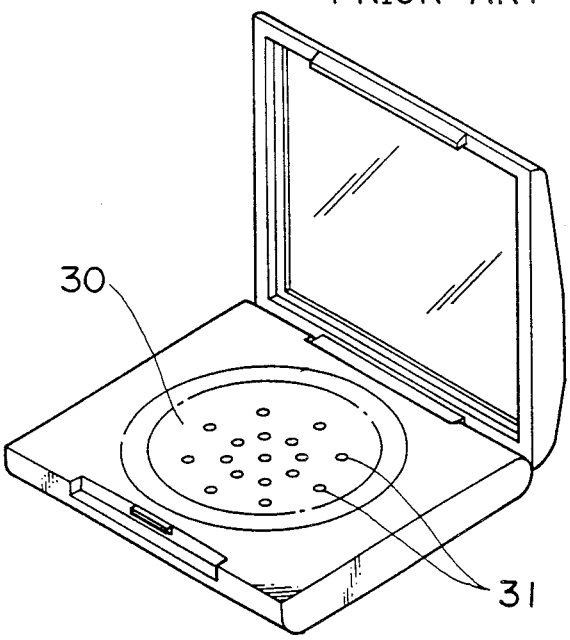
FIG.11 PRIOR ART
FIGS. 11 and 12 show the conventional compact case.
Figure 12:
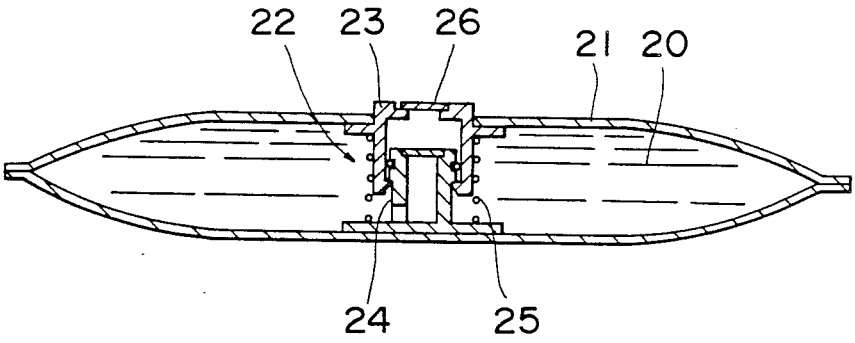
FIG.12 PRIOR ART

A second embodiment of the present invention will be described below with reference to FIG. 10.

An engagement hole 1*c* is formed in the bottom of the body 10 of the case 1, and a pair of engagement recesses 1*d* are formed in the inner surfaces of side wall portions of the case body 10. A swingable frame 12 is attached to the case body 10. A pair of axial projections 12*a* are formed on side wall portions of the swingable frame 12 so as to be able to with the engagement recesses 1*d*.

A flat plate 2 is placed on the swingable frame 12, and a sealed sack 4 to be filled with a cosmetic material 3 such as a foundation is attached to the lower surface of the flat plate 2.

A pump 5 for discharging the cosmetic material 3 is provided inside the sealed sack 4. The pump 5 has the same construction as that of the first embodiment. A bottom portion of a piston 9 of the pump 5 is fitted in the engagement hole 1*c*. Other details of the construction or other components are the same as those of the first embodiment. They are therefore designated with the same reference symbols and the description for them will not be repeated.

In this embodiment, the inner tray 13 is not provided and the bottom portion of the piston 9 is directly fixed to the case body 10. In accordance with this embodiment, the compact case can be constructed from a smaller number of components.

The operation of this embodiment is substantially the same as the first embodiment, and the description for it will not be repeated.

In accordance with the present invention, as described above, the flat plate is disposed in the case body, the pump for discharging the cosmetic material is disposed under the flat plate, and the cover is stretched so as to cover the discharge hole of the pump, thereby preventing the cosmetic material from contacting the outside air and enabling maintenance of the desired sealing performance. There is therefore no risk of hardening of the cosmetic material, and the cosmetic material can be discharged always smoothly.

The construction of the pump, in which the piston of the pump is fixed to the case body and in which the flat plate swingably disposed is swung to effect the contraction/expansion movement of the pump for resetting of the pump and for discharging, enables the pump to be operated in a simpler manner and facilitates the use of the compact case.

What is claimed is:

1. A compact case comprising:

a case body;

a flat plate disposed movably in said case body;

a sealed sack to be filled with a cosmetic material, said sealed sack being disposed under said flat plate;

a pump disposed is said sealed sack, said pump being capable of discharging said cosmetic material when driven by said flat plate, said pump having a discharge hole formed in said flat plate;

a cover stretched over an upper surface of said flat plate so as to cover said discharge hole; and a slit formed in said cover so as to communicated with said discharge hole, said slit is made as a line placed in a position shifted from said discharge hole.

2. A compact case according to claim 1, wherein said slit is slanted as viewed in a cross section of said cover.

3. A compact case according to claim 1, wherein said flat plate is axially supported swingably at an axial support point, said pump is placed in a position shifted from the axial support point of said flat plate, and a portion of said pump is fixed to said case body, said flat plate being swung to effect expansion and contraction movements of said pump for resetting of said pump and for discharging operation of said pump.

4. A compact case according to claim 3, further comprising a lid hinged to a rear end portion of said case body, and a swingable frame on which said flat plate is supported and which is attached to said case body, said swingable frame having side wall portions and a pair of axial projections formed on said side wall portions offset from a center of said side wall portions toward a front end of said case body, said swingable frame being supported so as to be rotatable about said axial projections, wherein said flat plate supported on said swingable frame is swingable about said axial projections, and said pump is mounted to a lower surface of said flat plate at a position between the axial support point and a rear end of said flat plate.

5. A compact case according to claim 4, wherein said lid drives said flat plate to reset said pump when closed.

6. A compact case according to claim 1, wherein said pump has a cylinder fixed to a lower portion of said flat plate, a piston fixed to said case body, a cylinder valve disposed at an outlet hole of said cylinder and serving as a check valve through which said cosmetic material can flow from an interior of said cylinder to said discharge hole, and a piston valve disposed at a suction hole of said piston and serving as a check valve through which said cosmetic material can flow from an interior of said sealed sack to the interior of said cylinder.

* * * * *